US007216771B2

(12) United States Patent
Huish

(10) Patent No.: US 7,216,771 B2
(45) Date of Patent: May 15, 2007

(54) STORAGE UNITS

(76) Inventor: Ronald Leslie Huish, 5 Bewley Court, Chard, Somerset. TA20 1LD (GB)

( * ) Notice: Subject to any disclaimer, the term of this patent is extended or adjusted under 35 U.S.C. 154(b) by 283 days.

(21) Appl. No.: 10/828,774

(22) Filed: Apr. 21, 2004

(65) Prior Publication Data

US 2005/0011841 A1 Jan. 20, 2005

(51) Int. Cl.
*A47F 7/00* (2006.01)

(52) U.S. Cl. ..... 211/70.6

(58) Field of Classification Search ..... 211/70.6, 211/85.7, 13.1, 60.1, 71.01, 73, 90.01, 119.009
See application file for complete search history.

(56) References Cited

U.S. PATENT DOCUMENTS

D176,162 S * 11/1955 Steece ..... D6/528
2,974,804 A * 3/1961 Maro ..... 211/70.6
3,187,902 A * 6/1965 Nelson ..... 211/70.6
D259,314 S * 5/1981 Nordlund ..... D6/569
4,583,647 A * 4/1986 Schinzing ..... 211/60.1
5,743,416 A * 4/1998 Yemini ..... 211/70.6
5,927,519 A * 7/1999 Koonts et al. ..... 211/85.7
6,749,074 B1 * 6/2004 Hileman et al. ..... 211/85.7
6,877,619 B1 * 4/2005 Han ..... 211/65

* cited by examiner

*Primary Examiner*—Sarah Purol
(74) *Attorney, Agent, or Firm*—Melvin I. Stoltz

(57) ABSTRACT

A tool storage unit comprises a plate (15) that, in use, is attached to a supporting structure in such manner as to be disposed substantially horizontally. The plate (15) is so formed as to provide a plurality of spaced tool support formations (16, 17, 18 and 19) of a plurality of configurations,

6 Claims, 3 Drawing Sheets

STORAGE UNITS

FIELD OF THE INVENTION

This invention relates to storage units and is particularly concerned with the provision of an improved form of storage unit for use in the storage of garden tools.

Garden tools are often hung on pins or hooks, or stacked loosely against a wall of a shed or barn. Such methods of storage are space-consuming and not very safe.

It is accordingly an object of the present invention to provide a storage unit that can be used for the storage of garden tools in a space-saving, safe manner.

A variety of forms of tool storage units have previously been developed and typical examples are those shown in European Patent Specification No. 0 156 088, French Patent Specification No. 2 787 052, British Patent Specifications Nos. 2 363 711, 2 279 235, 1 586 965 and 1 543 383 and U.S. Patent Specifications Nos. 4,362,243 and 6,360,891, It is a more specific object of the present invention to provide a tool storage unit that is economical to produce and which is so designed that the mounting of tools on the storage unit can readily be effected.

SUMMARY OF THE INVENTION

According to the present invention there is provided a tool storage unit comprising a back plate which, in use, is attached to a supporting structure in such manner as to be disposed substantially vertically and a top plate which, in use, is disposed substantially horizontally, said top plate having an outer periphery and being so formed as to provide a plurality of spaced tool support formations of a plurality of configurations, some of the spaced tool support formations being in the form of arcuate rebates formed in the outer periphery of the plate and some of the spaced tool support formations being in the form of circular apertures in the plate.

Some of the spaced tool support formations may be in the form of pins projecting from edges of the plate.

The storage unit may include additional support formations located beneath and spaced from the top plate, such additional support formations being, for example, afforded by a pin or pins secured to support gussets which act between the back plate and the top plate.

The top plate may be in the form of a plastics moulding having a substantially flat upwardly facing surface and having a plurality of reinforcing ribs on its downwardly facing surface.

DESCRIPTION OF THE PREFERRED EMBODIMENTS

Figure 1:
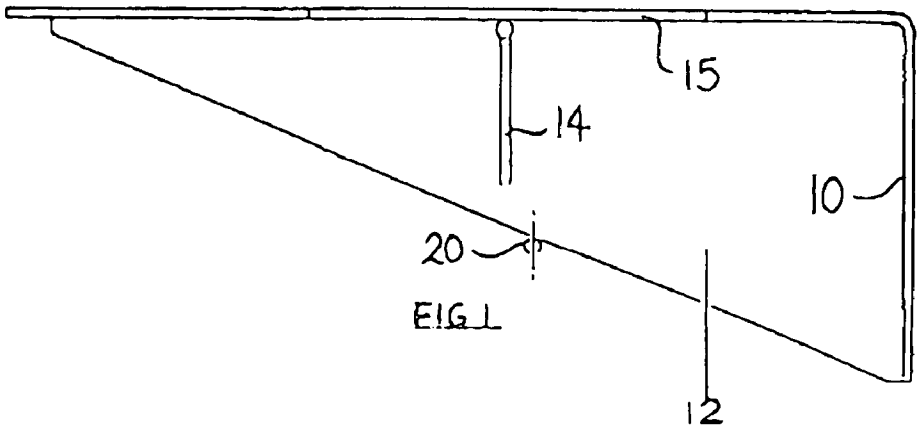
FIG. 1 is a side view of a storage unit.
Figure 2:
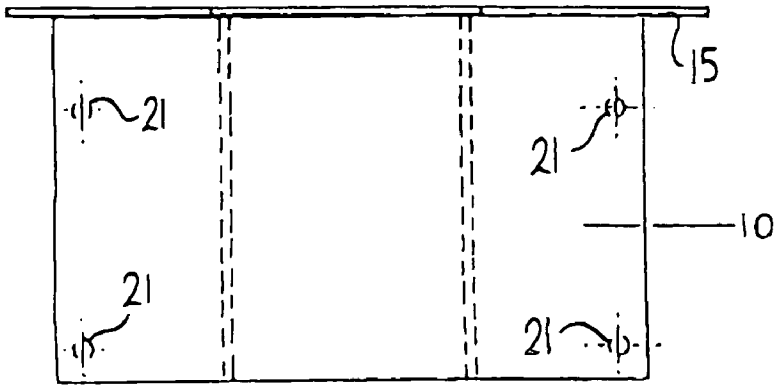
FIG. 2 is a rear view of the storage unit.
Figure 3:
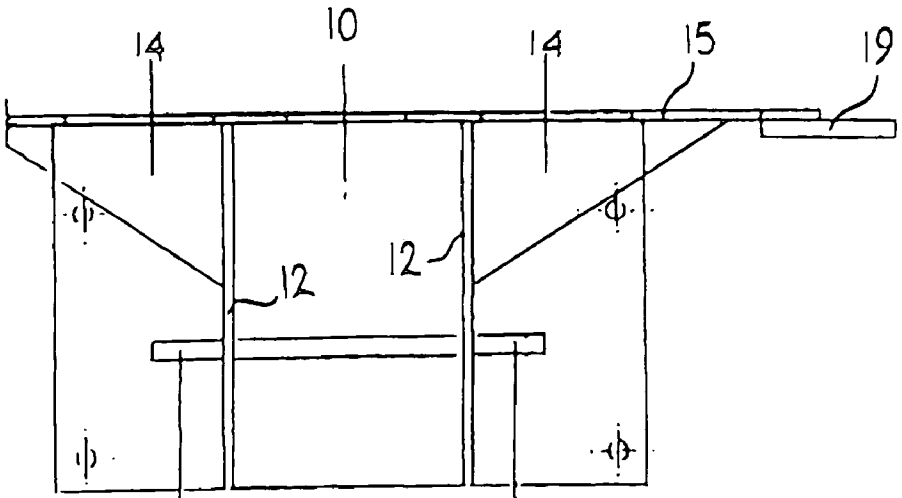
FIG. 3 is a front view of the storage unit.

The storage unit shown in FIGS. 1 to 4 of the drawings comprises a steel or other corrosion-resistant metal top plate 15 and an integral back plate 10 which is formed with spaced apertures 21 for receiving fasteners (not shown) for fixing the storage unit to a wall of a shed, barn or the like in such manner that the top plate 15 is substantially horizontal. As shown, a first pair of triangular gusset plates 12 are welded to the underside of the top plate 15 and to the front of the back plate 10, while a second pair of triangular gusset plates 14 are welded to the underside of the top plate 15 and to the first gusset plates 12. The gusset plates 12 and 14 provide stable support for the top plate 15 that contains tool support formations 16, 17, 18, 19 and 20. The width of one specific form of top plate can be 320 mm. while the depth thereof can be 298 mm. These dimensions are, of course, given purely by way of example. The tool storage unit of FIGS. 1 to 4 may alternatively be formed as a plastic fabrication or moulding.

In the specific embodiment shown in FIGS. 1 to 4 of the drawings, there are five tool support formations 16, which are in the form of curvate rebates, and these can be used to support garden tools such as forks, spades, rakes and lawn edgers, the tools having shafts which fit in the curvate rebates and heads or the like which rest on the surrounds of the rebates, so as to be located by the tool support formations 16. As can be seen from FIG. 4, each of the curvate support formations 16 extends inwardly from the outside periphery of the top plate 15 and has a configuration comprising just in excess of a semi-circle.

There are two tool support formations 17, which are in the form of circular apertures in the top plate 15, and these can be used to support tools such as hand forks and trowels. There is one tool support formation 18, which is in the form of a circular aperture at the centre of the top plate 15, and it can be used to support, for example, a pair of hand shears. In the specific embodiment shown in FIGS. 1 to 4 of the drawings, the circular aperture affording support formation 18 has a greater diameter than the circular apertures affording support formations 17. For example, formation 18 may have a diameter of 45 mm. while formations 17 each have a diameter of 40 mm.

Tool support formations 19 are in the form of horizontal pins or pegs welded to the underneath of the top plate 15 and projecting centrally from the sides of the top plate 15. Formations 19 can be used to support garden tools such as draw hoes and spring rakes.

Tool support formations 20 are afforded by a horizontal pin welded to the triangular gussets 12 at positions spaced from the underside of the top plate 15. The tool support formations 20 can be used to support, for example, pruners and transplant forks.

As will be apparent from FIGS. 1 to 4 of the drawings, tool support formations 16, 17, 18, 19 and 20 are so arranged that, when a plurality of tools of different kinds are supported on the respective formations 16 to 20, access can be obtained to any one of the tools without interfering significantly with any of the other tools.

Figure 4:
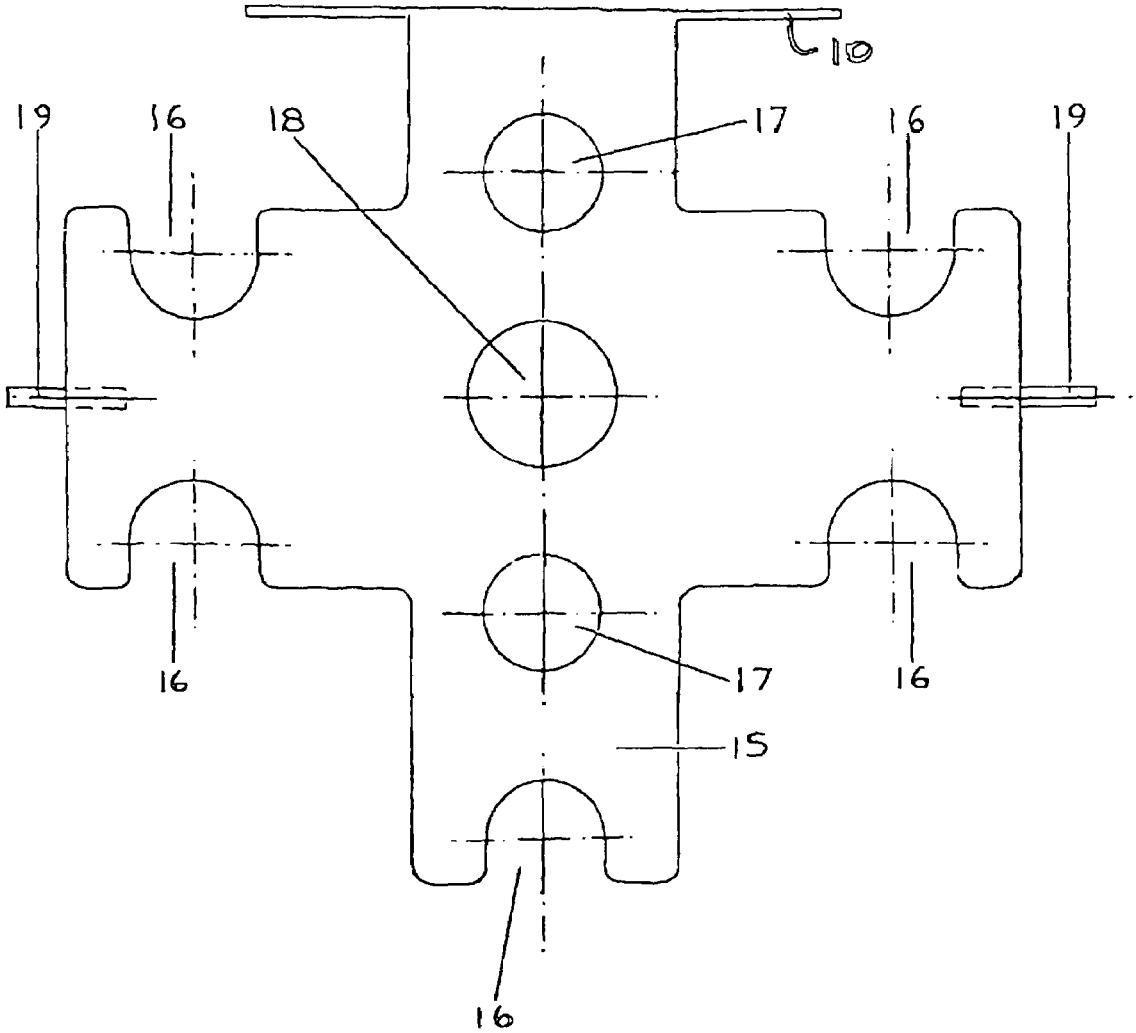
FIG. 4 is a plan view of the storage unit.

As will be seen from FIG. 4, two of the curvate support formations 16 face towards the back plate 10, and hence towards the wall to which the storage unit is attached. When, therefore, the user wishes to remove a tool from one of the rearwardly facing tool support formations, he or she will lift the tool, and then move it to the rear and subsequently to the side. The movements described above are carried out in reverse to replace a tool in one of the rearwardly facing tool support formations 16.

As will also be seen from FIG. 4, three of the curvate support formations 16 face away from the wall on which the storage unit is mounted. It will thus be a very simple matter for a user to place the shank of a tool in one of these forwardly facing support formations 16 and then lower the tool so that the head of the tool rests on and is supported by the part of the top plate 15 adjacent the selected support formation 16.

Figure 6:
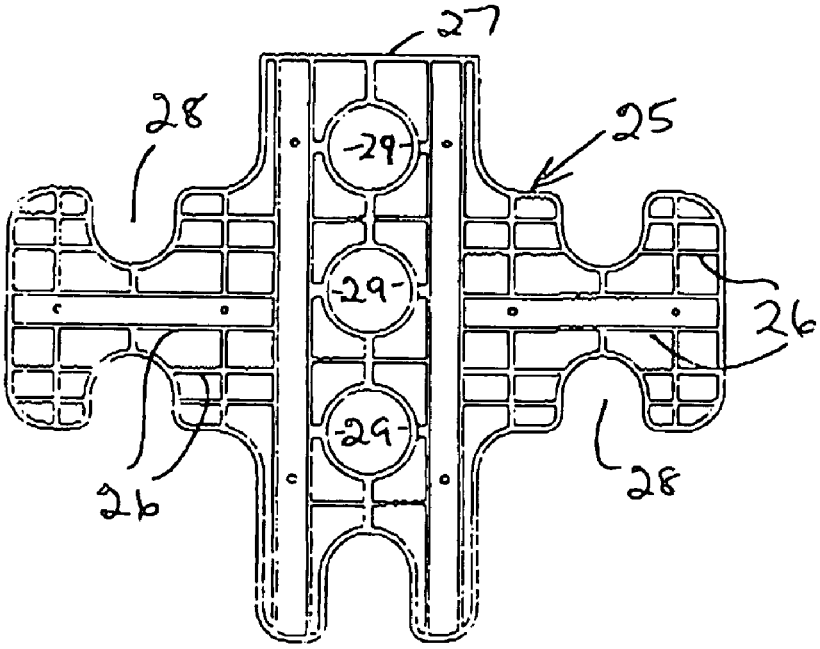
FIG. 6 is an underneath plan view of the top plate shown in FIG. 5.
Figure 5:
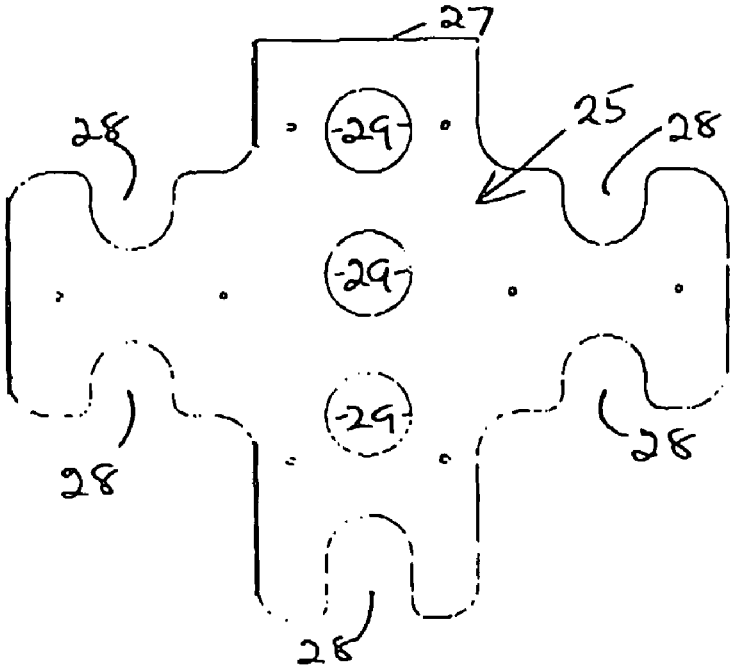
FIG. 5 is a plan view of an alternative form of top plate for a storage unit.

FIGS. 5 and 6 show an alternative form of top plate 25 that is in the form of a plastic moulding having a substantially flat upwardly presented surface and a downwardly facing lower surface from which extend an array of reinforcing ribs 26. One edge 27 of the top plate 25 is straight and this straight edge 27 is secured to a separately moulded back plate (not shown) that is secured (in use) to a wall or other support surface.

The periphery of the top plate 25 is formed with five inwardly extending arcuate rebates 28 (corresponding to the rebates 16 of the embodiment shown in FIGS. 1 to 4). There are again three forwardly facing rebates 28 and two rearwardly facing rebates 28. There are three circular apertures 29 in the central part of the top plate 25 but, in this case, the circular apertures 29 are all of one size.

It will be seen from the above that the invention provides a tool storage unit that is economical to produce, and simple to install in a required position. It enables the user to store a variety of garden tools safely and in a space saving manner. Access to the tools can readily be obtained and placing of the tools in the apertures and rebates can easily be effected.

The invention claimed is:

1. A tool storage unit comprising a back plate which, in use, is attached to a supporting structure in such manner as to be disposed substantially vertically and a top plate which, in use, is disposed substantially horizontally, said top plate having an outer periphery and being so formed as to provide a plurality of spaced tool support formations of a plurality of configurations, some of the spaced tool support formations being in the form of arcuate rebates formed in the outer periphery of the plate and facing away from and towards the back plate.

2. A tool storage unit as claimed in claim 1, in which some of the spaced tool support formations are in the form of pins projecting from edges of the top plate.

3. A tool storage unit as claimed in claim 1, which includes additional support formations located beneath and spaced from the top plate.

4. A tool storage unit as claimed in claim 3, in which the additional support formations are afforded by pins secured to gussets that act between the back plate and the top plate.

5. A tool storage unit as claimed in claim 1, in which the top plate is in the form of a plastic moulding having a substantially flat upwardly presented surface and having a plurality of reinforcing ribs on its downwardly facing surface.

6. A tool storage unit comprising a back plate which, in use, is attached to a supporting structure in such manner as to be disposed substantially vertically and a top plate which, in use, is disposed substantially horizontally, said top plate having a plurality of outer edges and being so formed as to provide a plurality of spaced tool support formations of a plurality of configurations, some of the spaced tool support formations being in the form of arcuate rebates formed in the outer edges of the plate and some of the spaced tool support formations being in the form of circular apertures in the plate, some of the arcuate rebates facing towards the back plate and some of the arcuate rebates facing away form the back plate.

* * * * *